United States Patent [19]

Schicketanz

[11] Patent Number: 4,828,253

[45] Date of Patent: May 9, 1989

[54] TWO PERSON EXERCISE DEVICE

[76] Inventor: Jay S. Schicketanz, 123½ Pearl Ave., Balboa Island, Calif. 92662

[21] Appl. No.: 75,546

[22] Filed: Jul. 20, 1987

[51] Int. Cl.[4] ..... A63B 21/00

[52] U.S. Cl. ..... 272/126; 272/902; 272/143

[58] Field of Search ..... 272/902, 93, 142, 143, 272/120, 121, 126, 127, 117, 135–138, 109

[56] References Cited

U.S. PATENT DOCUMENTS

| | | | |
|---|---|---|---|
| 374,496 | 12/1887 | Reach | 272/118 |
| 1,572,802 | 2/1926 | Layman | 272/902 X |
| 3,858,874 | 1/1975 | Weider | 272/126 |
| 4,047,714 | 9/1977 | Powell | 272/902 X |
| 4,251,070 | 2/1981 | Lesebarg | 272/143 |
| 4,267,617 | 12/1986 | Gelmora et al. | 272/120 |
| 4,423,866 | 1/1984 | Stolba | 272/143 |

FOREIGN PATENT DOCUMENTS

| | | | |
|---|---|---|---|
| 508253 | 10/1920 | France | 272/902 |
| 1333776 | 6/1963 | France | 272/126 |
| 4394 | of 1912 | United Kingdom | 272/137 |
| 425012 | 2/1926 | United Kingdom | 272/126 |
| 687153 | 2/1953 | United Kingdom | 272/117 |

*Primary Examiner*—Richard J. Apley
*Assistant Examiner*—J. Welsh

[57] ABSTRACT

A variable ratio multi-purpose exercise device for simultaneous use by two opponents in which the opponents transmit force and resistance to each other through a block and pulley combination which is so adjustable as to balance out strength difference between the two. The device utilizes identical first and second hand lines each of which runs through a plurality of pulleys and has at its termini a snap hook. Each of the hand lines passes through the block of a main pulley fixed to an external support structure and then through the blocks of secondary pulleys located on both sides of the main pulley. The secondary pulleys are each attached to a handle bail which, in turn, is adjustably attached to the handle. In operation, opponents may perform movements which exercise the same muscle groups in each of them or one opponent may elect to exercise a different muscle group than that selected for exercise by the other.

3 Claims, 4 Drawing Sheets

TWO PERSON EXERCISE DEVICE

BACKGROUND OF THE PRESENT INVENTION

The present invention relates to exercise and fitness devices generally and more particularly to those exercise and fitness devices which utilize flexible hand line or ropes. It is readily apparent to one familiar with the art that many exercise devices exist. Some of these incorporate flexible hand lines and most are intended for single user applications. Some two participant exercise devices exist but, as will be more fully disclosed herein, no such two participant exercise devices possess the versatility and adaptability of the present invention. As an example, because of the flexibility of handline adjustment afforded by the present invention, opponents who are not matched in terms of size and/or strength can still profitably utilize it. Further, in operation of the device, opponents are not limited to exercising the same respective muscle groups. That is, one opponent may elect to exercise the musculature of the upper body while the opponent simultaneously performs rowing exercises for the benefit of the lower body musculature.

It is well known in the art of two person exercise inventions that devices exist which achieve a direct linear connection between opponents. These devices permit the opponents to pull against, or resist, force applied by one opponent against the other. Generally, force and resistance to force are transmitted through a moving center of effort along a line or other means directly connecting the opponents.

The game of tug-a-war, for example, is an athletic contest between two teams which haul at the opposite ends of a line, each trying to drag the other over a marker between them. In U.S. Pat. No. 4,411,426, an invention is disclosed which employs two hand line members which may be operated by two or four people in working the lines back and forth through a pulley. As in the case of the tug-a-war, the invention of U.S. Pat. No. 4,411,426, unlike the invention herein disclosed, employs a moving center of effort, i.e. a twin pulley, located between the contestants.

Neither in the case of the classic tug-a-war nor in the invention disclosed in the above mentioned patent is there any capacity for the discrete establishment and variation of the angle of travel and ratio of resistance for any handles or other gripping members. The present invention, on the other hand, permits independent determination of both the angle of travel and ratio of resistance for each of its four handle members by separating and fixing the center of effort of each flexible line in main pulleys attached to external support structures.

OBJECTS AND SUMMARY OF THE INVENTION

It is an object of the present invention to provide a novel and versatile two-person exercise and fitness apparatus which is adaptable to a very broad range of user applications.

It is another object of the present invention to provide a two opponent exercise and fitness device which utilizes simple, readily available components which cooperate in combination to comprise a device capable of a broad range of applications and functions.

It is still another and further object of the present invention to provide an exercise and fitness device that is simple in operation and inexpensive in construction that may be used in differing environments for different user applications.

It is still another and further object of the present invention to provide an exercise and fitness device that is capable of simultaneous use by opponents of different sex and by opponents of different ages, weights, strengths and endurance.

It is still another and further object of the present invention to provide an exercise and fitness device that allows each opponent to select particular muscle groups for exercise independently of the muscle groups selected for exercise by the other opponent.

It is still another and further object of the present invention to provide an exercise and fitness device that is capable of use by an individual.

It is still another and further object of the present invention to provide an exercise and fitness device which is sufficiently adjustable as to be operable by persons who are physically handicapped.

It is still another and further object of the present invention to provide an exercise and fitness system which is of low cost, versatile in performance and capable of use not only in the gym or fitness center but also in the home or office.

The two person exercise device herein disclosed provides a broad range of exercise capabilities which include, but are not limited to, such exercises as butterflies, military presses, bench presses, swimming motions, torso twists, curls, reverse curls, pull downs and rowing exercises.

The exercise and fitness device herein dislosed presents important advantages over other known devices. In the first place, the elements of the invention cooperate in such a manner that two opponents transmit force and resistance to each other through a block and pulley combination which balances out strength differences between the two.

In addition, as the opponents work against each other, each tires so that a bilateral decrease in resistance is generally experienced thereby reducing the probability that one opponent of greater size or strength will overwhelm the other. In addition, the invention provides the capacity for one partner to work out with another, thereby relieving the boredom usually experienced by users of individual exercise devices and introducing the element of competition between the opponents.

While the disclosure herein emphasizes the utilization of the present invention as a two person exercise device, it will be readily apparent to one skilled in the art of such devices that the invention can be operated by a single individual, who would be capable of performing the exercises herein disclosed, by the provision of resistance means, such as a weight, spring, bungee or other elastic resistance in the place and performing the resistance function of an opponent.

In operation, the invention directs the force exerted by two opponents through an identical pair of flexible lines or ropes and a corresponding pair of block-and-pulley components. In its usual configuration, the block-and-pulley components are fixedly or adjustably attached to external support structures such as the opposite walls of a room. However, it is clear to one familar with the relevant art that the points of attachment for the components could be on adjacent walls or, in some cases, on the same wall.

The attachment of the main block and pulley components to the external support structure may be through various well known means such as by connection to an eye-bolt, chain plate or vertically mounted traveller which, in turn, is secured to the external support structure. It will be readily apparent to one familiar with the art that the height of attachment of the main block and pulley component relative to the floor can be varied so as to facilitate the exercise of particular muscle groups of the opponents.

In operation, the main block and pulley components direct the force and motion imparted by one opponent pulling on a pair of handles at the ends of the flexible handlines to a similar pair of handles in the grip of the other opponent.

All handles are slideably connected to the flexible handlines by blocks and pulleys over which the lines pass. The handlines have attachment means at their termini, such as snap hooks, which may be affixed at the location of the main pulley, at the location of the handles, or at intermediary locations along the line between the two, thereby providing for extensive adjustability of handline length. Thus, handline length may be adjusted by one opponent, or by both, to accomodate the size limitations of the space in which they utilize the invention and to vary the length of travel of the lines, thereby changing the ratio of handline travel distance and the amount of force one opponent must exert to balance, or cancel out, the force and direction of handline travel initiated by the other.

BRIEF DESCRIPTION OF THE DRAWINGS

The accompanying drawings show, for puposes of exemplification and without limiting the invention or the claims to said invention, certain practical embodiements which illustrate the principles of this invention wherein:

DETAILED DESCRIPTION OF THE PREFERRED EMBODIEMENTS

Figure 1:
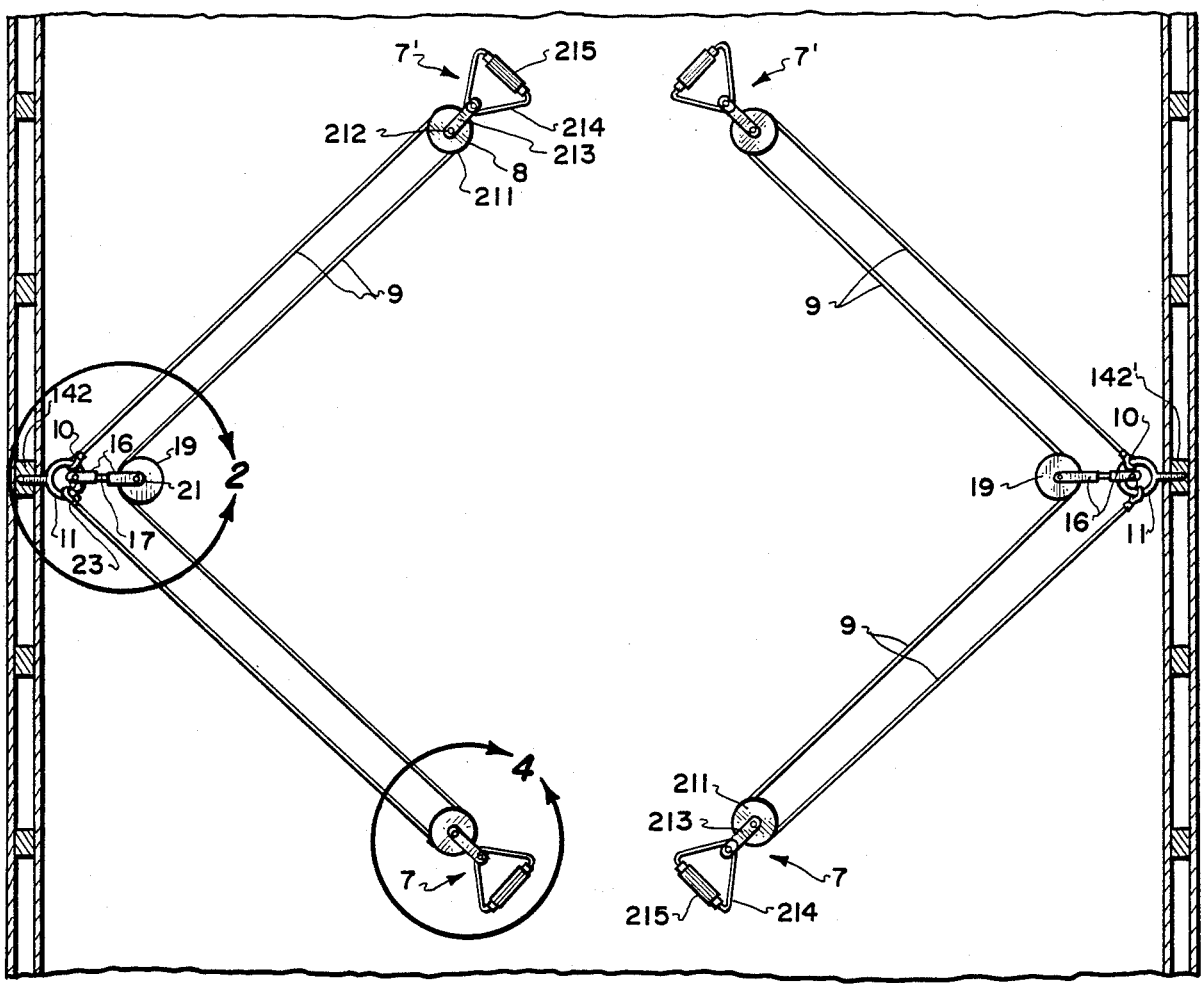
FIG. 1 is a top view of the invention depicting its attachment to opposite support structures and one embodiement of the flexible line in a position of intermediate adjustment.

Referring to FIG. 1, and, for illustrative purposes only and not by way of limitation of the invention and its various applications, substantially symmetrical left and right configurations of the invention are depicted. The right side in FIG. 1 is seen as originating at snap hook 10 detachably engaging eye-bolt 11, said snap hook being spliced or knotted at each terminus of handline 9. The handline passes over and along handle pulley 211 at handle assembly 7' thence over and along main pulley 19 and on to another handle pulley 211 at handle assembly 7. Handline 9, after traversing handle assembly 7 continues on to eye-bolt 11 where it terminates in a snaphook 10 in detachably secured relationship with said eye-bolt.

By way of further reference to FIG. 1, the left side of the invention is attached to an external support structure 142 while the right side of the invention is similarly attached to another external support structure 142'. External support structures 142 and 142' are, typically, opposite and parallel interior room walls. However, it will be readily apparent to one skilled in the art of exercise devices that the invention is operable when external support structures 142 and 142' are located on adjacent walls and even on the same wall. In some applications, one or both of the external support structures could be located on a floor or ceiling.

In addition to versatility in the location of the external support structures 142 and 142', the invention is not limited in its attachment to said structures to a specific height from the floor. In use, however, it has been found that for opponents whose heights range from approximately five to over six feet the ideal distance from the floor for attachment to the external support structures can range from three inches to sixty inches on opposite walls of an average sized room or office.

In use, two opponents position themselves roughly between the external support structures. The lengths of the flexible handlines 9 are adjusted. Such adjustment may be made by attachment of snap hooks 10 at eye-bolts 11, by detachment of the snap hook from one or more of said eye-bolts or by the opponents adopting positions so as to take up any slack in handlines 9. Further handline adjustability, if desired, can be attained by knotting handline 9 near line terminus hook 23. While the handline terminus clip, 23, is depicted as differing from snap hook 10, in practice each is a metal or plastic element which is interchangeable one with the other. It will be clear to one skilled in the art of exercise devices that if further adjustability of handline 9 is desired a flexible band or strip containing apertures for engagement of the snap hook or line terminus clip may be interposed between said snap hook or line terminus clip and eye-bolt 11.

Figure 6:
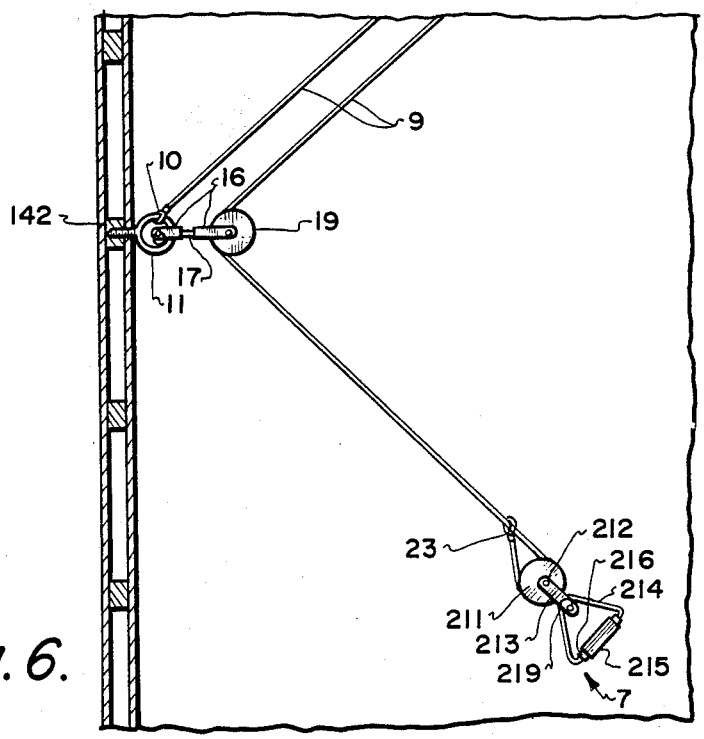
FIG. 6 is a partial top view of the invention depicting a second embodiement of the flexible line in a position of intermediate adjustment.

In practice, an opponent may alter the configuration and functional characteristics of the present invention at any time by employing the handline adjustment techniques discussed above. For example, one opponent may attach all the snap hooks to their respective eye-bolts while the other adjusts handline length as depicted in FIG. 6 and as more fully discussed below. In this configuration, the first opponent must exert twice the pulling force of the other in order to achieve equilibrium while his handle will travel only half the distance of his opponent. Thus, the handline adjustment shortens the absolute distance between handles which is a useful capability if the opponents elect to operate the invention in positions closer to the main pulleys or to each other. It is clear that shortening of the handlines by attaching all four snap hooks to their respective eye-bolts will result in neither opponent having a gearing or length-of-travel advantage.

The distance along the handlines between opposed handles is greatest when both opponents release all snap hooks and allow the handles to travel to the ends of the handline until they are stopped by the snap hooks. Those familiar with the art will recognize that the adjustment capability of the present invention is very extensive and is useful, for example, when the invention is used in differently sized rooms, or when one opponent is larger, stronger or using a larger muscle group in differing simultaneous exercises than the opponent or is executing a maneuver with a longer sweep than the opponent.

Figure 2:
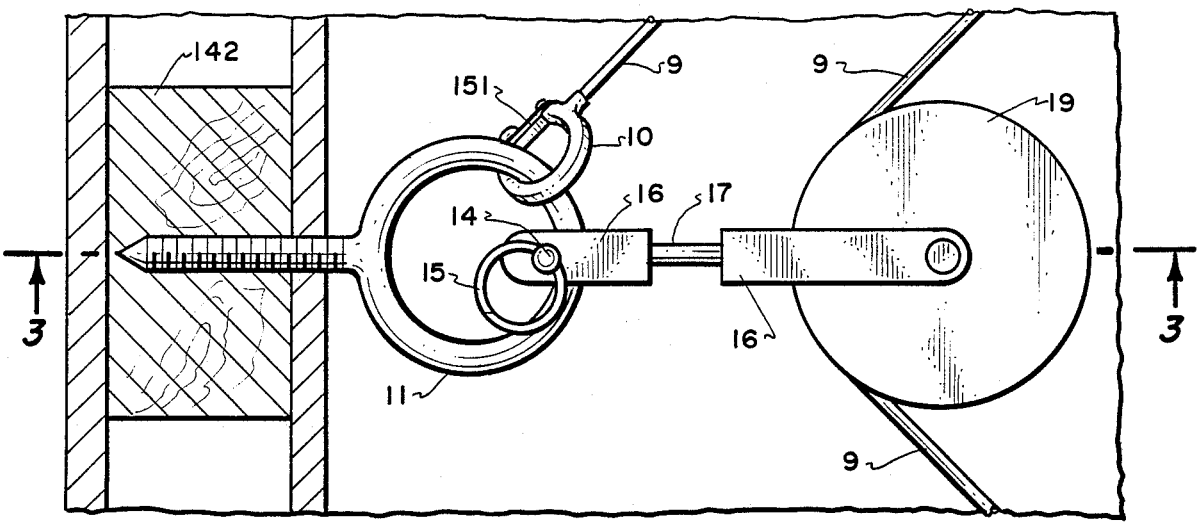
FIG. 2 is an expanded top view of the portion of FIG. 1 defined therein as 2.

In a preferred embodiement, and as depicted in FIG. 2, main pulley 19 is attached by means of pulley block 16 to eyebolt 11. It is readily apparent to one skilled in the art of exercise devices that the provision of pulley block swivel 17 increases the versatility of the invention by enabling the opponents great flexibility in their relative body attitudes. Thus, one opponent may comfortably operate the invention from a seated or supine position while the other is in a standing position. As further depicted in FIG. 2, the main pulley block keeper pin 14, together with the keeper pin ring 15, provide a means for readily removing the invention when it is not in use. Of course, removal of the exercise devise, as disclosed in FIG. 2, would necessitate disengagement of snap hook 10 which, in FIG. 2, is depicted as incorporating spring lock 151.

Figure 3:
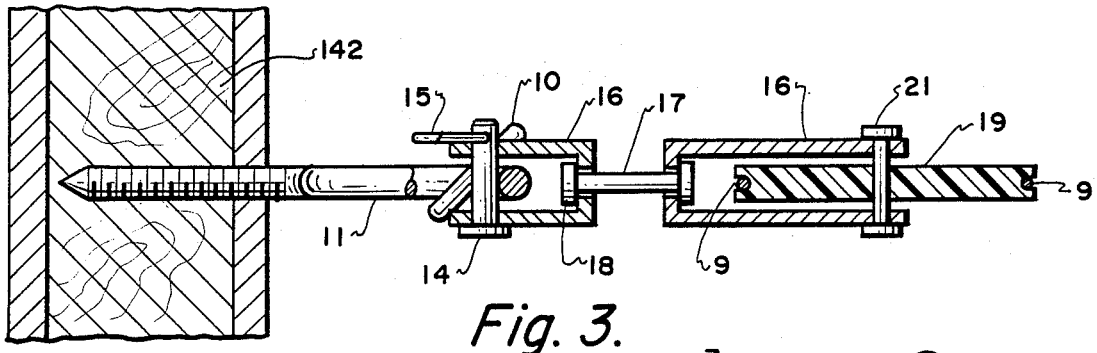
FIG. 3 is a view taken along the line 3—3 of FIG. 2.

With reference to FIG. 3, the relationship between handline 9 and main pulley 19, is depicted. Main pulley axis bearing 21 is depicted as fixing main pulley 19 in pulley block 16 while the two portions of pulley block 16 are pivotally attached by the pulley block swivel post 17 which is secured by main pulley block swivel cap 18. In addition, pulley block 16 is illustrated as secured to eyebolt 11 by main pulley block keeper pin 14.

Figure 4:
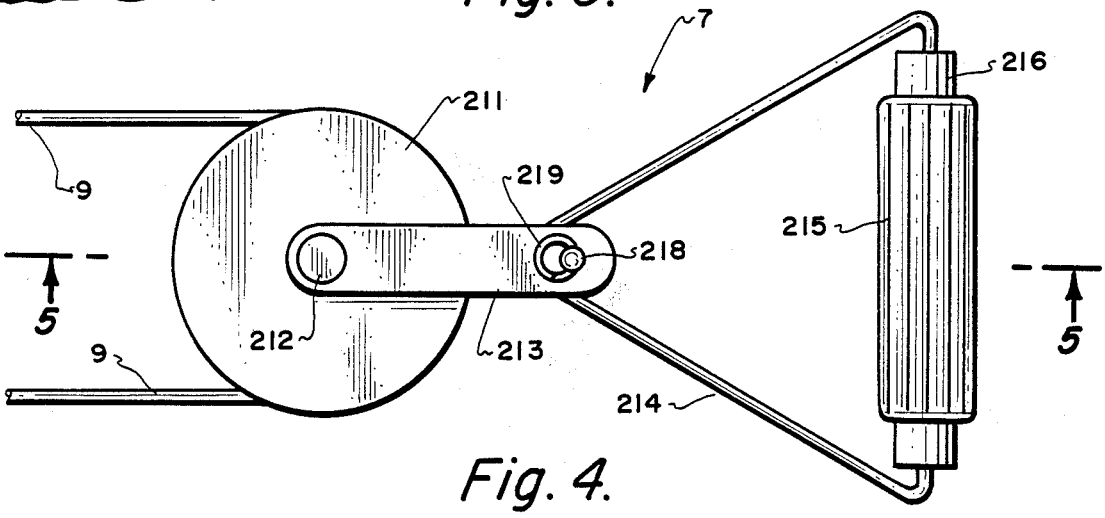
FIG. 4 is an expanded top view of the portion of FIG. 1 defined therein as 4.

In FIG. 4, handle assembly 7 is depicted in detail. Handline 9 is illustrated as passing over and along handle pulley 211 which is pivotally attached to handle pulley block 213 by means of handle pulley axis pin 212. Handle pulley block 213 is, in turn pivotally attached to handle bail 214 by the handle pulley block keeper pin 218 to which is attached handle pulley block keeper pin 218.

Figure 5:
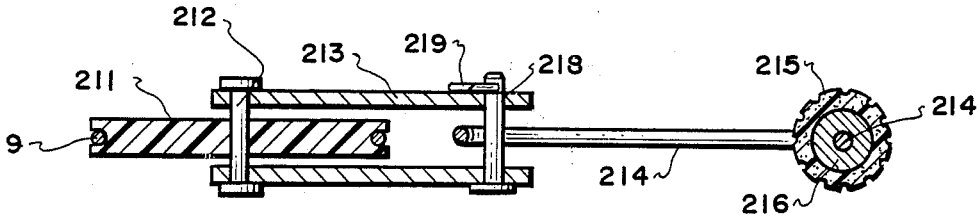
FIG. 5 is a view taken along the line of 5—5 of FIG. 4.

With further reference to FIG. 4, handle bail 214 is pivotally attached to handle grip 216 at both its extremities. Handle bail 214 may be constructed of rope, synthetic rope or other flexible material or it may be of rigid construction and made from wood, hard plastic, metal or similar materials. Handle grip 216 is rigid in nature and may be made of wood, hard plastic, metal or similar materials. In cross section, handle grip 216 may be round, oval or angular in shape. In the preferred embodiement, it is round and approximately one inch in diameter. As further depicted in FIG. 4, handle grip 216 is covered by handle grip cover 215 which may be of a rubber, synthetic rubber or other resilient material. With reference to FIG. 5, the relationship between handline 9 and handle pulley 211 is depicted. Handle pulley 211 is illustrated as pivotally attached to handle pulley block 213 by means of handle pulley block axis 212. Handle bail 214 is pivotally attached to handle pulley block 213 by handle pulley block keeper pin 218. With further reference to said figure, the relationship between handle bail 214 and handle grip 216 is depicted while handle grip cover 215 is depicted a having a ribbed configuration.

With reference to FIG. 6, the elements depicted in the prior drawings and discussed above are illustrated. In this figure, however, still another means for handline 9 adjustability is depicted.

Figure 7:
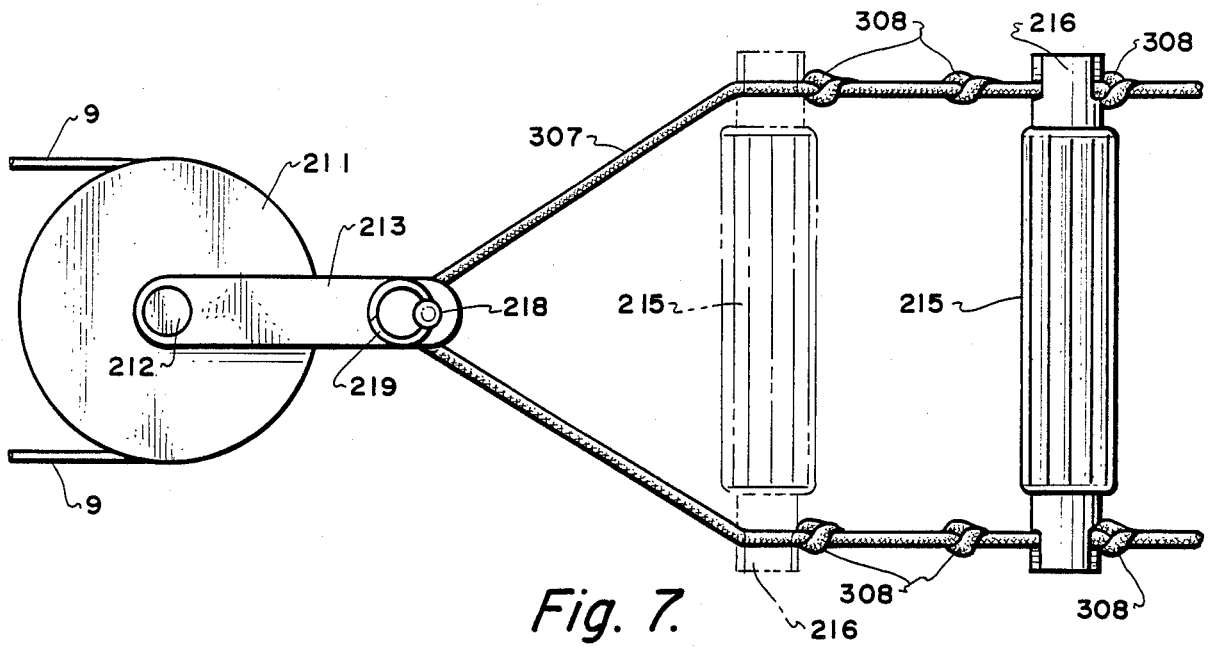
FIG. 7 is an expanded top view of the handle pulley and handle depicting one embodiement of the bail length adjustment means.

FIG. 7 depicts an embodiement of the invention in which handle bail 214 of FIGS. 4 and 5 has been replaced by handle bail line 307. In this figure, the relationships among handline 9, handle pulley 211, handle pulley axis 212, handle pulley block 213, handle pulley block keeper pin 218 and handle pulley block keeper pin ring 219 are as depicted in FIGS. 4 and 5. In the embodiment of handle assembly 7, depicted in FIG. 7, the rigid handle bail 214 has been replace by a flexible handle bail line 307 which may be constructed of rope, synthetic rope or other suitable flexible material., In this embodiement and as depicted in FIG. 7, handle bail line 307 passes through an aperture in handle grip 216. Adjustability of handle bail line 308 length is accomplished by the location of knot 308.

Figure 8:
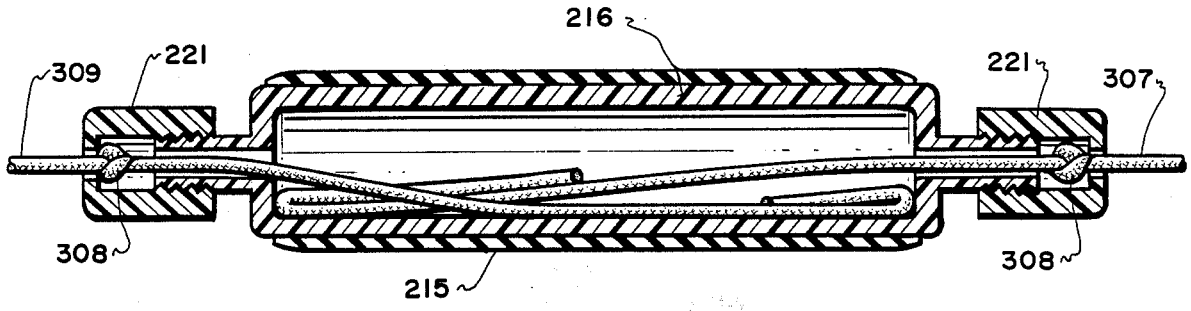
FIG. 8 is a sectional view of one embodiement of a handle assembly depicting a method of storage of the bail within the handle and another embodiement of bail adjustment means.

FIG. 8 depicts a lengthwise, sectional view through handle grip 216 in which said grip is threaded at its ends to receive handle grip cap 221. In this embodiement, adjustability of handle bail line 307 is accomplished by means of the location of knot 308 within handle grip cap 221. In this embodiement, unused portions of handle bail line 307 may be stored within handle grip 216. In this figure, on the left side, handle bail line 307 is erroneously identified as "309".

Figure 9:
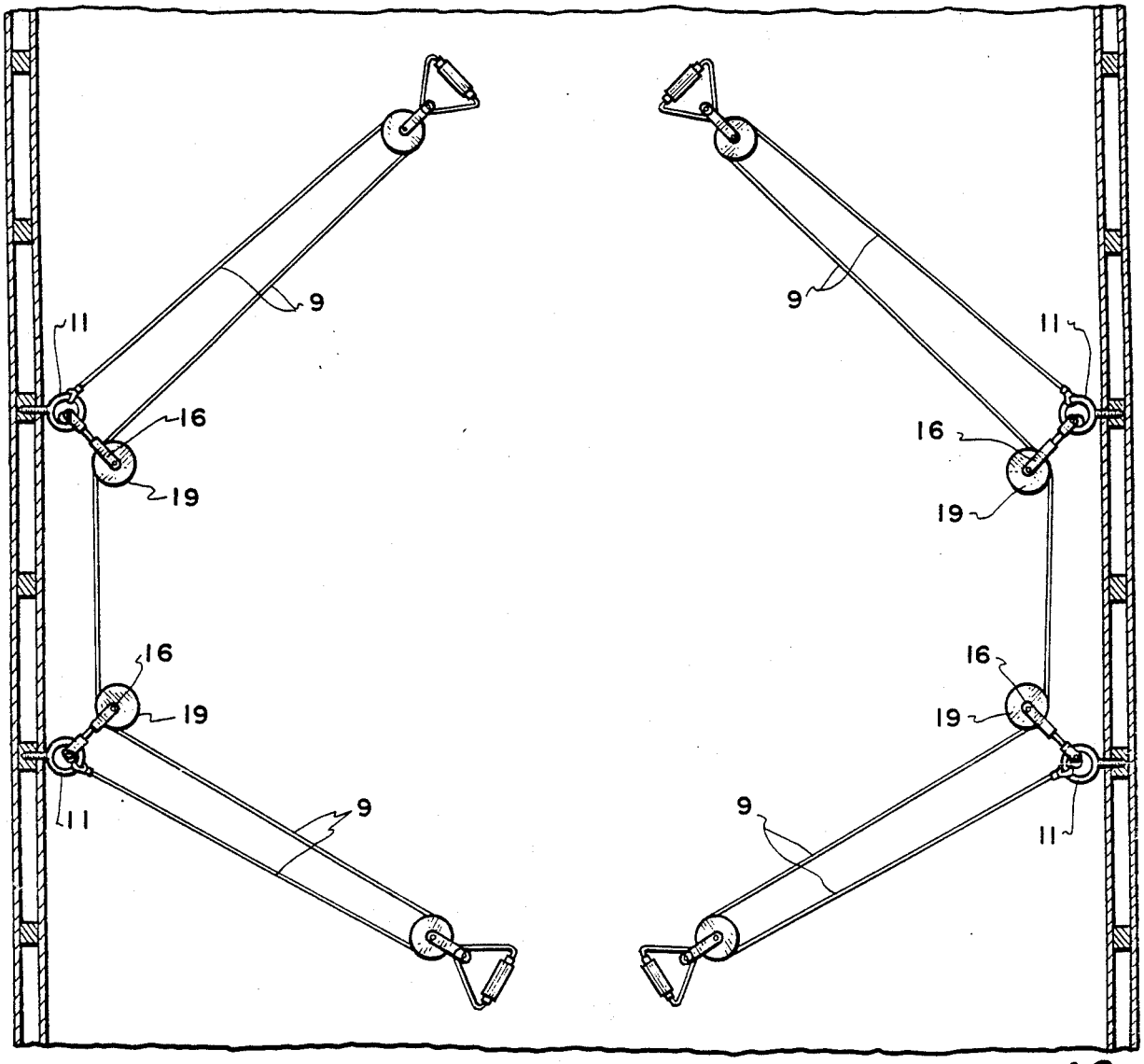
FIG.9 is a top view of an embodiement of the invention wherein a plurality of main pulleys is depicted.

With reference to FIG. 9, yet another embodiement of the invention is depicted. In this embodiement, the elements depicted in FIGS. 2 and 3 have been duplicated. In this emodiement, further advantages of convenience and versatility are realized since both opponents may simultaneously occupy positions directly between the points where force is immediately directed so that each opponent may be better balanced for certain exercises, especially those in which an opponent may elect to exercise certain muscle groups while relaxing overall.

Figure 10:
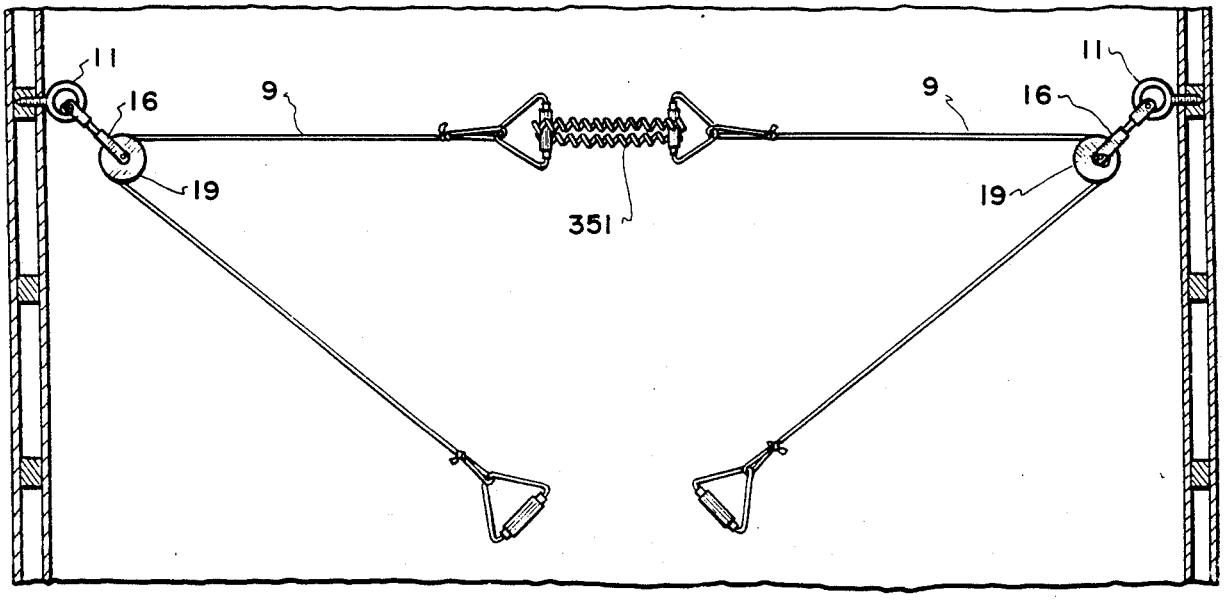
FIG. 10 is a top view of still another embodiement of the invention wherein a resistance means, instead of a second opponent, is depicted.

With reference to FIG. 10, a one person mode of operation is depicted in that resistance means 351 is illustrated as connecting the handle assemblies usually operated by the other opponent. Resistance means 351 may be a metal or heavy wooden weight or it may be a spring or constructed of suitable elastic material.

I claim:

1. A one or two user exercise device comprising at least one set of the following components; a first and second gripping member-pulley combination, each of which is slideably attached by said pulley to a single flexible handline having releasable connection means at each end thereof, which handline also passes over at least one additional pulley mounted to a vertically adjustable external support, wherein said handline starts at one of said ends attached to said external support travels around said first gripping member pulley, around said at least one additional pulley, around said second gripping member pulley and then is releasable attached at its other said end to either said external support or to said handline approximate said second gripping member pulley.

2. The exercise device in accordance with claim 1 in which said flexible line is adjustable in length.

3. The exercise device in accordance with claim 1 wherein each gripping member-pulley combination comprises a flexible bail of adjustable length retaining a block of said pulley, and a cylindrical or oval handle having at its extremities means for adjusting the effective length of said bail, and within which handle surplus bail length may be stored.

* * * * *